United States Patent [19]

Fitzgerald

[11] 4,341,621

[45] Jul. 27, 1982

[54] NEOMESOPHASE FORMATION

[75] Inventor: Cornelius G. Fitzgerald, Wallingford, Pa.

[73] Assignee: Exxon Research & Engineering Co., Florham Park, N.J.

[21] Appl. No.: 23,753

[22] Filed: Mar. 26, 1979

[51] Int. Cl.[3] ..... C10C 3/08

[52] U.S. Cl. ..... 208/45

[58] Field of Search ..... 208/39, 45

[56] References Cited

U.S. PATENT DOCUMENTS

| | | | |
|---|---|---|---|
| 3,505,090 | 4/1970 | Pinchbeck | 106/284 |
| 3,839,190 | 10/1974 | Frese et al. | 208/44 |
| 3,974,264 | 10/1976 | McHenry | 208/39 |
| 4,005,183 | 1/1977 | Singer | 208/44 |
| 4,032,430 | 6/1977 | Lewis | 208/39 |
| 4,042,486 | 8/1977 | Asano et al. | 208/39 |
| 4,184,942 | 1/1980 | Angier et al. | 208/44 |
| 4,208,267 | 6/1980 | Diefendorf et al. | 208/45 |

OTHER PUBLICATIONS

Mochida et al., Carbon, 13, No. Z-D, 135-139, 1975.
Mochida et al., Fuel, 57, 225-231, 1978.

*Primary Examiner*—Delbert E. Gantz
*Assistant Examiner*—William Leader
*Attorney, Agent, or Firm*—Joseph J. Dvorak

[57] ABSTRACT

An improved feedstock for carbon artifact manufacture, especially carbon fiber production, is made by reacting a carbonaceous isotropic graphitizable pitch with a dealkylation catalyst in the presence of an organic solvent system having a solubility parameter at 25° C. of between about 8.0 to about 9.5 to provide a solvent insoluble fraction over and above that originally in the pitch which is suitable for carbon artifact manufacture.

17 Claims, No Drawings

NEOMESOPHASE FORMATION

BACKGROUND OF THE INVENTION

1. Field of the Invention

This invention relates generally to the treatment of carbonaceous graphitizable pitches so as to render them particularly useful in the formation of shaped carbon articles and especially carbon fibers.

2. Description of the Prior Art

Carbon artifacts have been made by pyrolyzing a wide variety of organic materials. One carbon artifact of commercial interest today is carbon fiber. Hence, although particular reference is made herein to carbon fiber technology, it will be appreciated that this invention has applicability in areas other than carbon fiber formation.

Referring now in particular to carbon fibers, suffice it to say that the use of carbon fibers in reinforcing plastic and metal matrices has gained considerable commercial acceptance where the exceptional properties of the reinforcing composite materials, such as their high strength to weight ratios, clearly offset the generally high costs associated with preparing them. It is generally accepted that large-scale use of carbon fibers as a reinforcing material would gain even greater acceptance in the marketplace if the costs associated with the formation of fibers could be substantially reduced. Thus, the formation of carbon fibers from relatively inexpensive carbonaceous pitches has received considerable attention in recent years.

Many carbonaceous pitches are known to be converted at the early stages of carbonization into a spherical liquid crystal called mesophase. The presence of this ordered mesophase structure prior to carbonization is considered to be a significant determinant of the fundamental properties of the carbon fiber. Unfortunately the rate of mesophase formation from pitches is low. Additionally, carbonaceous pitches containing relatively large amounts of mesophase have relatively high softening points and viscosities making them difficult, if not impossible, to spin into fibers. Also, mesophase formation occurs at relatively high temperatures where incipient coking occurs. The presence of coke prior to spinning is also detrimental.

Significantly, it recently has been discovered that typical graphitizable carbonaceous pitches contain a separable fraction which possesses very important physical and chemical properties including: (1) a softening point and viscosity suitable for spinning; and (2) the ability to be converted in generally less than about 10 minutes and especially in less than about 1 minute when heated to temperatures in the range of about 230° to about 400° C., to an optically anisotropic deformable pitch material containing greater than 75% of a liquid crystal type structure. Since this highly oriented optically anisotropic pitch material formed from a fraction of an isotropic carbonaceous pitch has substantial solubility in pyridine and quinoline, it has been named neomesophase to distinguish it from the pyridine and quinoline insoluble liquid crystal materials long since known and referred to in the prior art as mesophase. Additionally, this separable fraction of the carbonaceous pitch capable of being converted to neomesophase is referred to as a neomesophase former fraction, or NMF fraction. Basically, the neomesophase former fraction of the pitch is isolated by solvent extraction of well-known, commercially available graphitizable pitches such as Ashland 240 and Ashland 260 to mention a few. The amount of neomesophase former fraction of the pitch that is separable, however, is relatively low. For example, with Ashland 240 no more than about 10% of the pitch constitutes a separable fraction capable of being thermally converted to neomesophase.

SUMMARY OF THE INVENTION

It has now been discovered that isotropic carbonaceous graphitizable pitches can be pretreated in such a manner as to increase the amount of that fraction of the pitch which is separable and capable of being converted very rapidly to a deformable pitch containing an optically anisotropic phase or liquid crystal type structure.

Broadly speaking, the present invention contemplates reacting a typical graphitizable isotropic carbonaceous pitch in the presence of an organic solvent system and a dealkylation catalyst. In general terms, the organic solvent system is selected from materials which will fractionate the pitch into a soluble fraction and a neomesophase former solvent insoluble fraction. Among the dealkylation catalysts suitable in the practice of the present invention are heavy metal halides, Lewis acids and Lewis acid salts. Such catalyst may include a solubilizing organic liquid in an amount sufficient to assure dissolution of the catalyst in the organic solvent system. The pitch is reacted with the catalyst at temperatures in the range of from about ambient temperature to about 250° C. and for a time sufficient to increase the neomesophase former fraction of the pitch.

These and other embodiments of the invention will be more readily understood from the following detailed description.

DETAILED DESCRIPTION OF THE INVENTION

The term "pitch" as used herein means petroleum pitches, natural asphalts, pitches obtained as by-products in the naphtha cracking industry, pitches of high carbon content obtained from petroleum, asphalt and other substances having properties of pitches produced as by-products in various industrial production processes. As will be readily appreciated, petroleum pitch refers to the residuum carbonaceous material obtained from distillation of crude oils and from the catalytic cracking of petroleum distillates. Synthetic pitches generally refers to residues obtained from the distillation of fusable organic substances.

Generally pitches having a high degree of aromaticity are suitable for carrying out the present invention. Indeed, aromatic carbonaceous pitches having carbon contents of from about 88% to 96% by weight and hydrogen contents of about 12% by weight to about 4% by weight are generally useful in the process of this invention. While elements other than carbon and hydrogen, such as sulfur and nitrogen to mention a few, are normally present in such pitches, it is important that these other elements do not exceed 4% by weight of the pitch; and this is particularly true when forming carbon fibers from these pitches. Also, these useful pitches typically will have a number average molecular weight of the order of about 300 to 4,000.

Another important characteristic of the starting pitches employed in this invention is that these pitches generally have less than 3 weight % and preferably less than 0.3 weight % and most preferably less than 0.1 weight % quinoline insolubles (hereinafter QI) such as coke, carbon black and the like. The QI of the pitch is determined by the standard technique of extracting the pitch with quinoline at 75° C. In the starting pitches, as indicated, the QI fraction typically consists of coke, carbon black, ash or mineral matter found in the pitches. In forming carbon articles, particularly in forming carbon fibers, it is important that the amount of foreign materials such as coke and carbon black be kept at an absolute minimum; otherwise, such foreign matter tends to introduce weaknesses in the fibers and deformities or other irregularities in the carbon articles prepared when using such starting pitches.

Those petroleum pitches which are well known graphitizable pitches meeting the foregoing requirements are the preferred starting materials for practicing the present invention. Thus, it should be apparent that commercially available isotropic carbonaceous pitches, particularly commercially available natural isotropic carbonaceous pitches, which are known to form mesophase in substantial amounts, for example in the order of 75% to 95% by weight during heat treatment at elevated temperatures, for example in the range of 350° C. to about 550° C., are especially preferred, inexpensive starting materials for the practice of the present invention.

As stated above, it has been recently discovered that pitches of the foregoing type have a solvent insoluble separable fraction which is referred to as a neomesophase former fraction or "NMF" fraction which is capable of being converted to an optically anisotropic pitch containing greater than 75% of a highly oriented pseudocrystalline material referred to as a neomesophase pitch. Importantly, the NMF fraction, and indeed the neomesophase itself, has a sufficient viscosity at temperatures in the range, for example, of 230° C. to about 400° C., so that it is capable of being spun into a pitch fiber.

It should be noted that the extent of the neomesophase formation resulting from heating an NMF fraction of a pitch is determined optically, i.e. by polarized light microscopic examination of a polished sample of the heated pitch which has been allowed to cool to ambient room temperature, e.g., 20° C. to 25° C. The neomesophase content is determined optically since the neomesophase material prepared by heating a concentrated and isolated NMF fraction has a significant solubility, for example 75% and greater, in boiling quinoline and pyridine. Indeed, the NMR fraction of a pitch when heated to a temperature which is about 30° C. above the point where the material becomes liquid (which is between about 230° C. to about 400° C.) provides an optically anisotropic deformable pitch containing generally below 25 weight % quinoline insolubles and especially below about 15 weight % QI. As indicated, the amount of QI is determined by quinoline extraction at 75° C. The pyridine insolubles, hereinafter PI, are determined by Soxhlet extraction with boiling pyridine.

In any event, in increasing the neomesophase former fraction of an isotropic pitch in accordance with the practice of the present invention, the carbonaceous isotropic pitch is treated with a dealkylation catalyst and in the presence of an organic solvent system, typically between ambient temperature and up to about 250° C. and preferably at about the boiling point of the particular solvent system chosen. Typical dealkylation catalysts suitable in the practice of the present invention include heavy metal halides, particularly heavy metal chlorides such as zinc chloride, ferrous and ferric chloride, cuprous and cupric chloride and the Lewis acids such as aluminum chloride, boron trifluoride, and the like, and Lewis acid salts, such as etherates and aminates of boron trifluoride. Such catalysts may include solubilizing organic liquids such as acetone, methanol, ethanol, ethylacetate, nitromethane and the like. The amount of solubilizing component used is that sufficient to render the catalyst soluble in the organic solvent system employed to separate the NMF fraction of the pitch.

The solvent system employed in the practice of the present invention generally will be one in which the dealkylation catalyst is soluble. Typically, such solvents include aromatic hydrocarbons such as benzene, toluene, xylene and the like. Preferably the organic solvent will also be one which is suitable in separating the neomesophase former fraction of the pitch from the remainder of the isotropic pitch. Generally such a solvent or mixture of solvents will have a solubility parameter of between about 8.0 and 9.5 and preferably between about 8.7 and 9.2 at 25° C.

The solubility parameter, δ, of a solvent or a mixture of solvents is given by the expression $$\delta = \left(\frac{H_v - RT}{V}\right)^{\frac{1}{2}}$$

where $H_v$ is the heat of vaporization of the material;
R is the molar gas constant;
T is the temperature in °K.; and
V is the molar volume.

In this regard, see, for example, J. Hildebrand and R. Scott, "Solubility of Non-Electrolytes", 3rd edition, Reinhold Publishing Company, New York (1949) and "Regular Solutions", Prentice Hall, New Jersey (1962). The solubility parameters at 25° for some typical organic solvents are as follows: benzene, 9.2; toluene, 8.8; xylene, 8.7; and cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred, having greater than about 60 volume % toluene such as 60% toluene-40% heptane and 85% toluene-15% heptane.

The amount of catalyst used in the practice of the invention is not critical and may vary over a relatively wide range, for example from about 0.2 wt.% based on the weight of pitch to about 5.0 wt.%. Nonetheless, it is generally preferred to use from about 1.0 wt.% to about 2.0 wt.% of the dealkylation catalyst based on the weight of pitch to be treated.

As should be readily appreciated, the amount of solvent employed in the practice of the present invention can vary considerably. In general, the amount of solvent to be used should be sufficient to dissolve at least a portion of the pitch, thereby leaving an insoluble concentrated neomesophase former fraction. Typically, from about 5 to about 150 milliliters and preferably from about 10 to 20 milliliters of aromatic hydrocarbon such as benzene, toluene or xylene per gram of an isotropic graphitizable pitch should be employed to provide an NMF fraction with preferred properties.

As will be appreciated, the choice of solvent or solvents employed, the temperature of extraction and the like will affect the amount and exact nature of the neomesophase former fraction separated. Hence, the precise physical properties of the NMF fraction may vary; however, in carbon fiber formation it is especially preferred that the fraction of the isotropic pitch that is isolated be a solvent insoluble fraction which will, upon heating to a temperature which is in the range of from about 230° C. to about 400° C., be converted to a deformable pitch which contains an optically anisotropic phase, which phase is substantially soluble, i.e. at least 75% soluble, in boiling quinoline. Preferably, the solvent insoluble fraction of the isotropic pitch that is isolated is a solvent insoluble fraction which will upon heating in the range of from about 230° C. to about 400° C. be converted to an optically anisotropic pitch of about 50% and even greater neomesophase. In other words, a sufficient portion of an isotropic pitch is dissolved in an organic solvent or mixture of solvents to leave, in the absence of any further treatment, a solvent insoluble fraction which, when heated in the range of from about 230° to about 400° C. for 10 minutes or less, and when examined by polarized light microscopy at magnification factors of from 10 to 1,000 for example will have greater than 50%, especially greater than 75%, of an optically anisotropic phase. Indeed, for the purpose of evaluating the optical anisotropy of the insoluble fraction of the pitch in accordance with this invention, the conventional technique of observing polished samples of appropriately heated pitch fractions by polarized light microscopy is not necessary; rather a simplified technique of observing the optical activity of crushed samples of the pitch can be employed. Basically, this simplified technique requires mounting a small sample of the pitch on a slide with a histological mounting medium such as the histological mounting medium sold under the trade name Permount by Fisher Scientific Co., Fairlawn, N.J. A slip cover is then placed on top of the mounted sample which is thereafter crushed between the slide and cover to provide an even dispersion of material for viewing under polarized light. The amount of optical anisotropy is estimated, based upon a comparison of samples with standards prepared by conventional techniques.

Continuing with the process of the present invention, having selected the catalyst and solvent, the isotropic pitch is reacted generally from ambient room temperature, say 20° C., preferably to reflux temperature in the presence of the catalyst and solvent system. The time for reacting is somewhat arbitrary; but, in any event, it is a time period sufficient to increase the solvent insoluble fraction of the pitch. Typically, reacting in the order of about 1 to 5 hours is sufficient and particularly from about 2 to 3 hours. After reacting, the solvent insoluble fraction is isolated. Preferably the solvent insoluble fraction is separated by filtration of the heterogeneous mixture.

A more complete understanding of the process of this invention can be obtained by reference to the following examples which are illustrative only and not meant to limit the scope thereof which is fully expressed in the hereinafter appended claims.

EXAMPLES 1 to 7

In these examples, a commercially available petroleum pitch, Ashland 240, was ground (100 Taylor mesh size), suspended in toluene (75 grams of pitch per 600 ml of toluene), and the temperature of the mixture of pitch and solvent was raised to 50° C. Catalyst was added as specified in Table I and the mixture was then heated to reflux temperatures. After refluxing the toluene insoluble fraction was separated by filtering the hot solution and the insoluble material was washed with 150 ml of toluene and with 150 ml of heptane to yield a neomesophase former fraction having the softening points and optical anisotropicity shown in Table I. For comparative purposes, in Example 1 shown in Table I catalyst was not employed.

In each example a sample of the toluene insoluble fraction of the pitch was heated in the absence of oxygen to the temperature indicated in Table I. After 5 minutes at the indicated temperature, the sample was allowed to cool to ambient temperature and a polished sample of the so heat treated material was examined under polarized light at a magnification factor of 100X.

TABLE I

| | Reaction Conditions | | | | Solvent Insoluble Product | | | |
|---|---|---|---|---|---|---|---|---|
| Example | Wt. % Catalyst | Addition Temp, °C. | Temp °C. | Time Hrs. | Wt. % Yield | Softening Range, °C. | % Anisotropy After 5 Min. | Temp, °C. Anisotropy Determined |
| 1 | None | NA | 110 | 2.0 | 3.1 | 400–425 | 100 | 400 |
| 2 | $2.0ZnCl_2$[a] | 50 | 110 | 2.0 | 13.9 | 350–375 | 20 | 375 |
| 3 | $2.7ZnCl_2$[b] | 50 | 110 | 4.0 | 14.9 | 350–375 | 100 | 375 |
| 4 | $2.0AlCl_3$[b] | 50 | 110 | 2.0 | 20.5 | 350–375 | 100 | 375 |
| 5 | $2.7AlCl_3$[b] | 50 | 110 | 4.0 | 23.2 | 325–350 | 100 | 350 |
| 6 | $2.0SnCl_4$[c] | 50 | 110 | 2.0 | 21.5 | 325–350 | 100 | 350 |
| 7 | $2.0BF_3$[d] | 50 | 110 | 2.0 | 13.3 | 350–375 | 100 | 375 |

NA - Not applicable.
[a]25 wt. % $ZnCl_2$ in acetone
[b]10 wt. % $AlCl_3$ in nitrobenzene
[c]10 wt. % $SnCl_4$ in toluene
[d]10 wt. % $BF_3$ in dibutyl ether

EXAMPLES 8 to 17

In these examples, the general procedure outlined in Examples 1 to 7 was followed. The catalyst in each example, however, was a solution of 10 wt.% anhydrous aluminum chloride dissolved in nitrobenzene. Reaction times and temperatures were varied as specified in Table II. Additionally, a sample of each of the solvent insoluble pitches, after heating to a temperature within their respective softening ranges, was examined under polarized light by mounting a sample on a slide with Permount, a histological mounting medium sold by Fisher Scientific Co., Fairlawn, New Jersey. A slip cover was placed over the slide and by rotating the cover under hand pressure the mounted sample was crushed to a powder and evenly dispersed on the slide. Thereafter the crushed sample was viewed under polarized light at a magnification factor of 100X and the percent optical anisotropy was estimated. In all instances the samples were estimated to contain greater than 75% of an optically anisotropic phase.

TABLE II

| | Reaction Conditions | | | | | Solvent Insoluble Product | |
|---|---|---|---|---|---|---|---|
| Example | Wt. % Catalyst | Solvent | Addition Temp, °C. | Temp, °C. | Time Hrs. | Wt. % Yield | Softening Range, °C. |
| 8 | 1.0 | Toluene | 30 | 30 | 18.0 | 19.8 | 325–375 |
| 9 | 1.0 | Toluene | 30 | 50 | 3.0 | 18.0 | 350–375 |
| 10 | 2.0 | Toluene | 35 | 110 | 3.0 | 24.1 | 350–375 |
| 11 | 1.0 | Toluene | 50 | 50 | 3.0 | 16.0 | 350–375 |
| 12 | 1.0 | Toluene | 50 | 80 | 3.0 | 19.2 | 350–375 |
| 13 | 1.0 | Toluene | 45 | 110 | 3.0 | 18.0 | 350–375 |
| 14 | 2.0 | Toluene | 50 | 110 | 2.0 | 20.5 | 350–375 |
| 15 | 1.0 | Toluene | 80 | 80 | 3.0 | 15.0 | 350–375 |
| 16 | 2.0 | Benzene | 50 | 80 | 2.0 | 21.3 | 325–350 |
| 17 | 2.0 | Xylene | 50 | 138 | 2.0 | 17.5 | 350–395 |

What is claimed is:

1. In the process of preparing an optically anisotropic deformable pitch by treating a carbonaceous isotropic pitch with an organic solvent system having a solubility parameter at 25° C. of between 8.0 and 9.5, said solvent system being in an amount sufficient to provide a solvent insoluble fraction which is capable of being converted into a pitch having greater than 75% of an optically anisotropic phase in less than 10 minutes when heated at about 30° C. above the point where the solvent insoluble fraction becomes liquid and thereafter separating and heating said solvent insoluble fraction whereby an optically anisotropic deformable pitch is obtained, the improvement comprising adding a dealkylation catalyst selected from heavy metal halides, Lewis acids, and Lewis acid salts to said organic solvent system and thereafter contacting said catalyst and said pitch in said solvent system at temperatures ranging generally from about ambient temperature to about 250° C. for a time sufficient to increase the solvent insoluble fraction of the pitch over that normally present therein, thereafter separating said solvent insoluble fraction from said solvent system and heating said solvent insoluble fraction at from about 250° C. to about 400° C. whereby an optically anisotropic deformable pitch is obtained.

2. The process of claim 1 wherein said dealkylation catalyst is selected from chlorides and bromides of tin, iron, zinc and copper.

3. The process of claim 1 wherein said Lewis acid is selected from the group consisting of aluminum chloride and boron trifluoride.

4. The process of claim 1 wherein said Lewis acid salt is selected from etherates and aminates of boron trifluoride.

5. The process of claim 1 wherein said organic solvent system is selected from aromatic hydrocarbons.

6. The process of claim 5 wherein the aromatic hydrocarbons are selected from benzene, toluene and xylene.

7. The process of claim 6 wherein said solvent is heated to its boiling point.

8. The process of claim 1 wherein said catalyst ranges from about 0.2 wt.% to about 5.0 wt.%, based on the amount of pitch.

9. A process for increasing the neomesophase former fraction of carbonaceous graphitizable isotropic pitch comprising:

heating said isotropic carbonaceous pitch at temperatures in the range of from about ambient temperature to about 250° C. in the presence of an organic solvent system having a solubility parameter at 25° C. of between 8.0 and 9.5 and in contact with a dealkylation catalyst selected from the group consisting of heavy metal halides, Lewis acids and Lewis acid salts, whereby the neomesophase former fraction of said pitch is increased over that normally present in said pitch.

10. The process of claim 9 wherein said heating is at a temperature of from about 25° C. up to the boiling point of said organic solvent system.

11. The process of claim 10 wherein said catalyst ranges from about 0.2 wt.% to about 5.0 wt.%, based on the amount of pitch.

12. An improved process for forming a feedstock capable of being thermally converted at temperatures of between about 230° C. and 400° C. to a deformable pitch containing an optically anisotropic phase comprising:

(a) selecting a graphitizable carbonaceous pitch containing less than 0.3 wt.% of substances which are insoluble in boiling quinoline;

(b) slurrying said pitch in an organic solvent system in an amount sufficient to provide a solvent insoluble fraction of said pitch which, when heated to a temperature in the range of from about 230° C. to about 400° C. and 30° C. above the point where the material becomes liquid, it is converted to a pitch containing greater than 75% of an optically anisotropic phase, said solvent system being selected from solvents and mixtures of solvents having a solubility parameter at 25° C. of between 8.0 and 9.5;

(c) adding to said solvent system a dealkylation catalyst selected from $SnCl_4$, $FeCl_3$, $ZnCl_2$, $AlCl_3$ and $BF_3$;

(d) contacting said pitch and catalyst in said organic solvent system at temperatures and for a time sufficient to increase the amount of solvent insoluble fraction; and (e) thereafter isolating a solvent insoluble fraction which is capable of being thermally converted to a deformable pitch containing an optically anisotropic phase.

13. The process of claim 12 wherein the catalyst ranges from about 0.2 wt.% to about 5.0 wt.% based on the amount of pitch.

14. The process of claim 13 wherein the catalyst ranges from about 1.0 wt.% to about 2.0 wt.%.

15. The process of claim 14 wherein the catalyst is zinc chloride and includes a solubilizing amount of acetone.

16. The process of claim 14 wherein the catalyst is aluminum chloride and includes a solubilizing amount of nitrobenzene.

17. The process of claim 14 wherein the catalyst is boron trifluoride and includes an organic ether.

* * * * *